US011495911B2

(12) United States Patent
Jaeger et al.

(10) Patent No.: US 11,495,911 B2
(45) Date of Patent: Nov. 8, 2022

(54) METHOD OF MAKING A PLUG CONNECTOR AND SEALING A CABLE THEREIN

(71) Applicant: HIRSCHMANN AUTOMOTIVE GMBH, Rankweil/Brederis (AT)

(72) Inventors: Guenter Jaeger, Goetzis (AT); Lukas Tomasini, Lustenau (AT)

(73) Assignee: HIRSCHMANN AUTOMOTIVE GMBH, Rankweil/Bredris (AT)

( * ) Notice: Subject to any disclaimer, the term of this patent is extended or adjusted under 35 U.S.C. 154(b) by 0 days.

(21) Appl. No.: 17/260,657

(22) PCT Filed: Jul. 31, 2019

(86) PCT No.: PCT/EP2019/070602

§ 371 (c)(1),
(2) Date: Jan. 15, 2021

(87) PCT Pub. No.: WO2020/025661

PCT Pub. Date: Feb. 6, 2020

(65) Prior Publication Data

US 2021/0265770 A1 Aug. 26, 2021

(30) Foreign Application Priority Data

Jul. 31, 2018 (DE) ..... 102018118481.6

(51) Int. Cl.
*H01R 43/00* (2006.01)
*H01R 13/52* (2006.01)

(52) U.S. Cl.
CPC ..... *H01R 13/5208* (2013.01); *H01R 43/005* (2013.01)

(58) Field of Classification Search
CPC ..... H01R 13/5208; H01R 13/5812; H01R 13/504; H01R 13/5829–43/005
See application file for complete search history.

(56) References Cited

U.S. PATENT DOCUMENTS 6,464,532 B1 * 10/2002 L'Abbate ..... H01R 12/772 439/467
10,581,195 B2 3/2020 Linseder

FOREIGN PATENT DOCUMENTS

DE 102011055215 A 5/2012
EP 2105996 A 9/2009

* cited by examiner

*Primary Examiner* — Vanessa Girardi
(74) *Attorney, Agent, or Firm* — Andrew Wilford

(57) ABSTRACT

An injection-molded support has a contact chamber adapted to receive a contact partner, a fixed seal part, a movable seal part shiftable relative to the fixed seal between an open position spaced therefrom and a closed position closely juxtaposed therewith, and a break point holding the movable seal part in the open position and frangible for movement of the movable seal part into the closed position. A cable end fitted between the seal parts into the chamber is clamped when the movable seal part is then moved from the open into the closed position with rupturing of the break element and is held in form-fitting clamping engagement of the cable end between the seal parts. Finally the cable end is overmolded with molding compound to the contact body outside the contact chamber while blocking entry of the compound by the seal parts into the contact chamber.

7 Claims, 3 Drawing Sheets

METHOD OF MAKING A PLUG CONNECTOR AND SEALING A CABLE THEREIN

CROSS REFERENCE TO RELATED APPLICATIONS

This application is the US-national stage of PCT application PCT/EP2019/070602 filed 31 Jul. 2019 and claiming the priority of German patent application 102018118481.6 itself filed 31 Jul. 2018.

FIELD OF THE INVENTION

The invention relates to a plug connector and to a method of making the plug connector that has a contact support that is injection molded from plastic and has contact chambers for receiving respective contact partners, wherein furthermore provided is a sealing element that acts on an outer jacket of at least one cable that extends out of the plug connector and the end of whose electrical conductor is connected to the respective contact partner, wherein the sealing element is formed together with the contact support from plastic processed in an injection molding process.

BACKGROUND OF THE INVENTION

A plug connector of the generic type is known from DE 10 2011 055 215 A1. This plug connector has a plastic support that is injection molded from plastic and has contact chambers for receiving respective contact partners, wherein furthermore provided is a sealing element that acts on an outer jacket of at least one cable that extends out of the plug connector and the end of whose electrical conductor is connected to the respective contact partner, wherein the sealing element is formed together with the contact support from plastic processed in an injection molding process. A method of making a plug connector is likewise disclosed, this plug connector having a contact support that is injection molded from plastic and has contact chambers for receiving respective contact partners, wherein furthermore provided is a sealing element that acts on an outer jacket of at least one cable that extends out of the plug connector and the end of whose electrical conductor is connected to the respective contact partner, wherein the sealing element is likewise produced from plastic in an injection molding process and joined to the contact support after this sealing element has been produced. In this respect, the joining connection to the sealing element is designed such that the movable part of the sealing element protrudes laterally, which can lead to damage during the packaging, transport and processing.

OBJECT OF THE INVENTION

The invention is based on the object of improving a plug connector of the generic type and also a method of the generic type in terms of the production of the plug connector such that the disadvantages described are avoided.

SUMMARY OF THE INVENTION

The object of the invention is achieved in that after the contact support is loaded with a corresponding number of contact partners that have been inserted into their respective contact chamber in the contact support, the at least one predetermined break point can easily be severed so that the sealing element that previously did not bear against the outer jacket of the cable, comes to bear closely against the outer jacket of the cable, in order thus to prevent injection molding compound for producing a housing around the contact partner from penetrating into the inner region of the contact chambers of the contact support. The contact support is thus loaded with contact partners that are arranged at the end of the cable, more precisely at the end of the electrical conductor of the cable, and then the at least one predetermined break point, preferably exactly the two predetermined break points, is severed, so that the sealing element, together with an respective geometry on the contact partner, seals the respective contact chamber to the effect that the situation in which, when a housing of the plug connector is injection molded, injection molding compound does not penetrate into a contact chamber. This can be effected by a force-fitting and/or form-fitting connection, for example a latching connection. The arrangement of the sealing element over the at least one predetermined break point on the contact support has the advantage that this sealing element is available for the subsequent injection molding process and cannot be lost or forgotten.

In a development of the invention, it is provided that the sealing element has a fixed part arranged on the contact support and a latching part that is articulated via the at least one predetermined break point. In this respect, it is preferable when two predetermined break points are provided on both sides between the fixed part and the latching part. The predetermined break points are aligned in the longitudinal direction with respect to the plug connector, with the result that the latching part can be displaced by a transverse movement with respect to the plug connector for the purpose of sealing at least one cable. The latching part or the fixed part has lateral tabs that correspond to grooves on the fixed part or latching part, so that the parts are guided with respect to one another as a result. Provided in the region of the tabs and grooves are latching elements that create a form-fitting connection of the latching part to the fixed part.

In addition, provided on the fixed part and the latching part, preferably on the outer surfaces thereof, are projections that can be latched into openings on a sealing cap. The projections can, however, also serve as guide elements for a sealing cap encapsulated by injection molding. The sealing cap that can be arranged over the end of the contact support, receives a form-fitting fastening as a result. Encircling sealing lips can be provided on the projections in order to improve the sealing of the sealing cap on the projections.

BRIEF DESCRIPTION OF THE DRAWING

A single embodiment of the invention is illustrated in a simplified manner in the drawings, in which.

SPECIFIC DESCRIPTION OF THE INVENTION

Figure 1A:
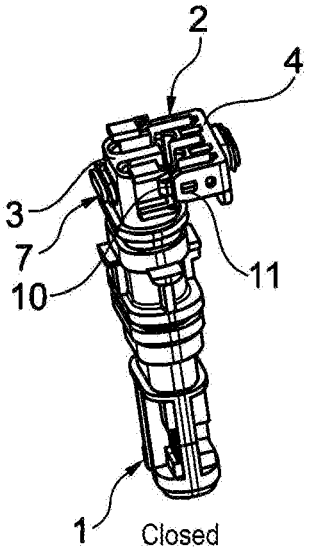
FIG. 1A-1C show three views of a contact support, a latching part being fixed via predetermined break points in FIG. 1A, the latching part being connected to a fixed part of the sealing element in FIG. 1B, and the contact support being shown in enlarged scale, corresponding to the central view from the top, in the FIG. 1C, FIGS. 2 and 3 show the left-hand view of FIG. 1B and the central view of FIG. 1B of FIG. 1 in enlarged scale.
Figure 1B:
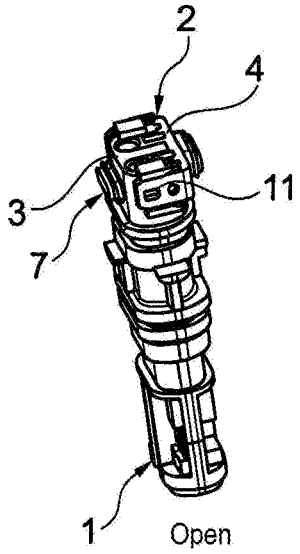
Figure 1C:
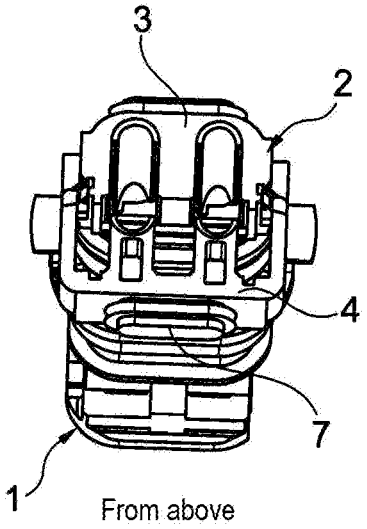
Figure 6:
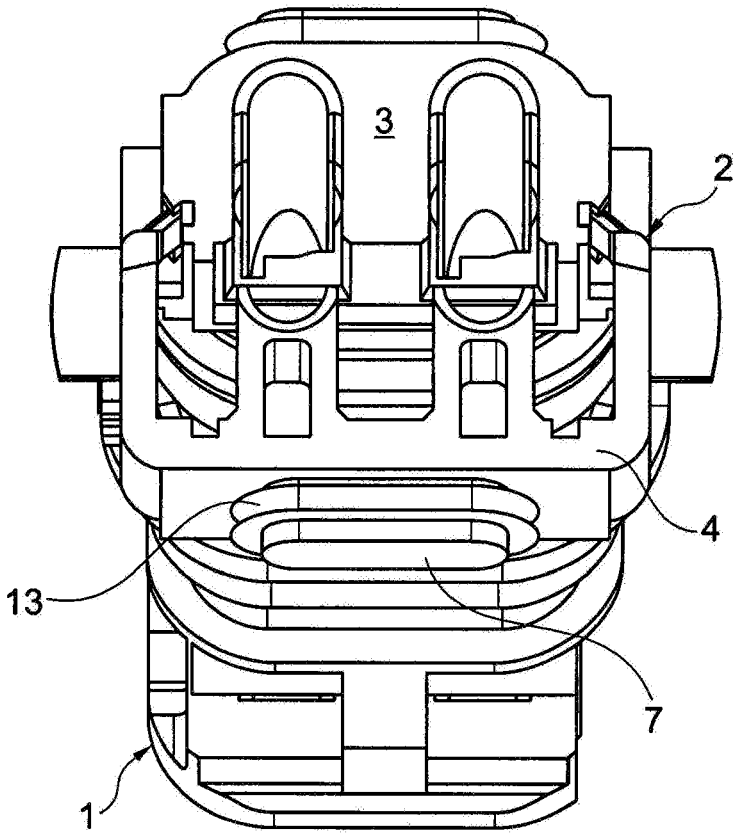
FIG. 6 shows a view of the contact support from above as per FIG. 1A in enlarged scale.
Figure 2:
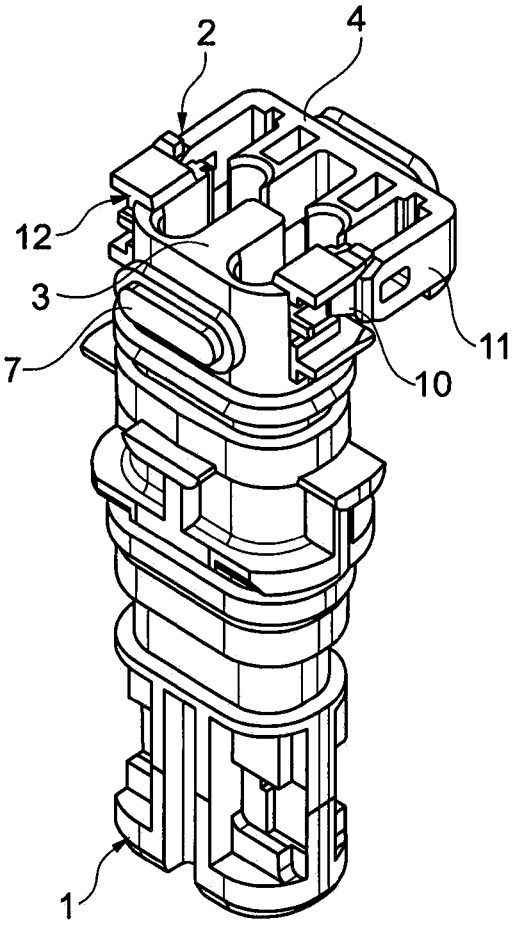
Figure 3:
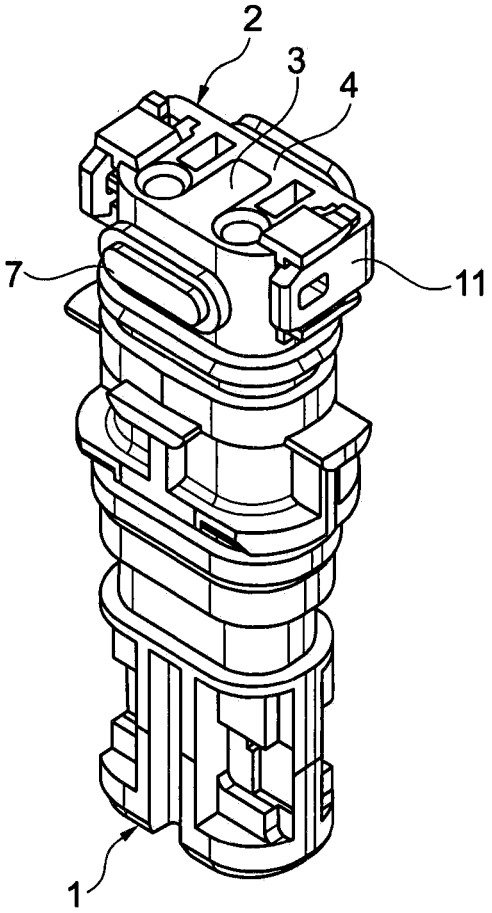

Referenced by the reference numeral 1 in FIGS. 1 to 6, to the extent to which it is shown specifically, is a contact support having a sealing element 2. The sealing element 2 contains, inter alia, a fixed part 3 fixed to the sealing element and a latching part 4 that is fixed by predetermined break points 10 to the fixed part 3 and/or to the sealing element 2. Grooves 12 are incorporated on the fixed part 3 of the sealing element 2 adjacent the predetermined break points 10. The latching part 4 has tabs 11 that are aligned with the grooves 12. If the latching part 4 is displaced in the direction of the fixed part 3 as per FIG. 2 in the view as per FIG. 3, first the predetermined break points 10 are detached and the latching part 4, while being guided by the tabs 11 and the grooves 12, is moved toward the fixed part 3 and is connected in a form-fitting manner to this fixed part.

Figure 4:
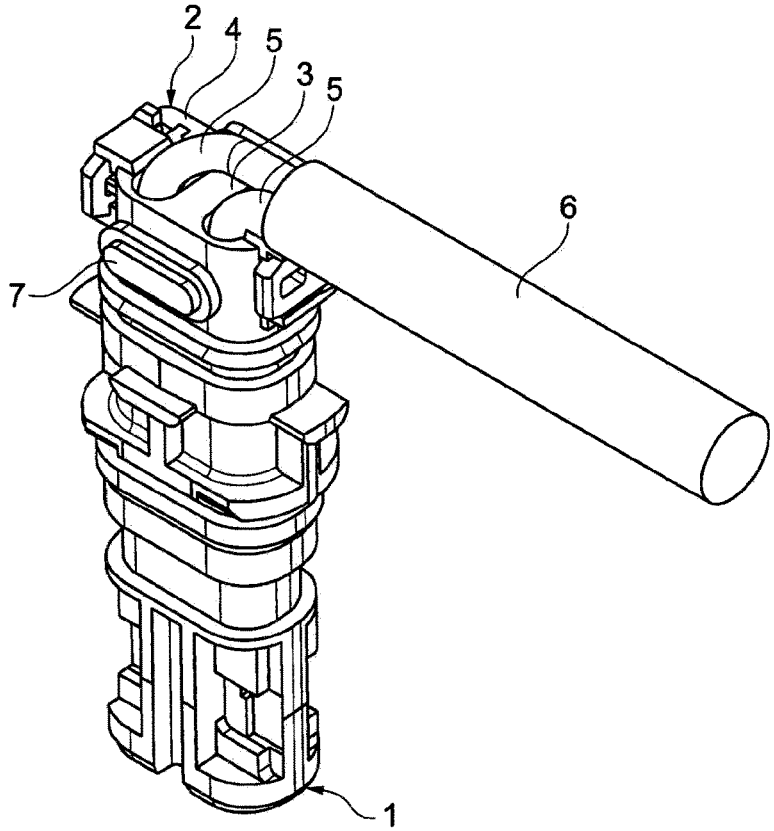
FIG. 4 shows a contact support with two connected cables and a protective sleeve.
Figure 5:
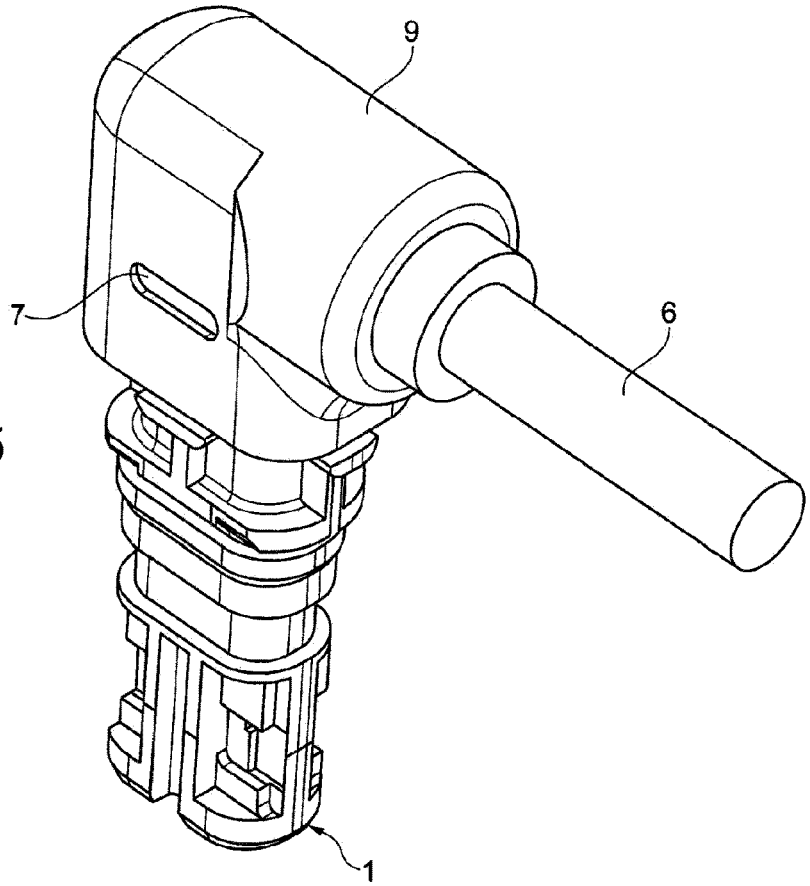
FIG. 5 shows a wired contact support with protective sleeve and additional sealing cap.

If, as illustrated in FIG. 4, cables 5 are inserted beforehand into the contact support 1 and/or the sealing element 2, the outer jacket of the cable 5 is clamped in between the fixed part 3 and the latching part 4 and sealed.

An additional sealing of the region of the plug connector 1, sealing element 2 and cable(s) 5 is brought about by a sealing cap 9 that can be injection molded on or latched in by openings on projections 7. Sealing lips 13 on the projections 7 improve the sealing. The projections 7 are arranged in the region of the sealing element 2 on the outer walls of the fixed part 3 and of the latching part 4.

The invention claimed is:

1. A method of making a plug connector and sealing a cable therein comprising the steps of sequentially:

injection molding of one piece a contact support formed unitarily with a contact chamber adapted to receive a contact partner, a fixed part, a latching part shiftable relative to the fixed seal between an open position spaced therefrom and a closed position closely juxtaposed therewith, and a break point holding the latching part in the open position and frangible to allow movement of the latching part into the closed position;

fitting a cable end between the fixed and latching parts into the chamber in the open position of the latching part;

moving the latching part from the open position into the closed position with rupturing of the break element so as to clamp the cable end in a form fit between the fixed and latching parts;

latching the latching part in the closed position with form-fitting clamping engagement of the cable end between the fixed and latching parts; and overmolding the cable end with molding compound to the contact body outside the contact chamber while blocking entry of the compound by the fixed and latching parts into the contact chamber.

2. The method according to claim 1, wherein the latching part has lateral tabs that movable transversely in grooves on the fixed part.

3. The method according to claim 1, wherein latching hooks and latching eyes are arranged formed by the injection molding on the tabs and in the region of the grooves and serve for latching the movable seal element in the closed position.

4. The method according to claim 1, further comprising the step of:

forming projections by the injection molding on the fixed part and the latching part and that serve as guide elements for a sealing cap encapsulated by injection molding or as latching bodies for openings on the sealing cap.

5. The method according to claim 1, wherein the projections have encircling sealing lips.

6. The method according to claim 1, wherein two predetermined break points are provided on opposite sides of the contact support between the fixed part and the latching part.

7. The method according to claim 3, wherein the predetermined break points are aligned in a longitudinal direction with respect to the contact support and the latching part can be displaced by a transverse movement with respect to the contact support for the purpose of sealing around the cable end.

* * * * *